US007490724B2

(12) United States Patent
Weck et al.

(10) Patent No.: US 7,490,724 B2
(45) Date of Patent: Feb. 17, 2009

(54) POINT-OF-SALE DEVICE FOR AN ARTICLE HAVING PLURAL INTERFITTING PARTS

(75) Inventors: David Weck, Miami, FL (US); Steven C. Berenson, Miami, FL (US); Edson A. Mejia, Miami, FL (US)

(73) Assignee: Micasa Trading Corporation, Miami, FL (US)

( * ) Notice: Subject to any disclaimer, the term of this patent is extended or adjusted under 35 U.S.C. 154(b) by 329 days.

(21) Appl. No.: 11/383,527

(22) Filed: May 16, 2006

(65) Prior Publication Data

US 2007/0267373 A1 Nov. 22, 2007

(51) Int. Cl.
*B65D 73/00* (2006.01)
*A47G 1/16* (2006.01)

(52) U.S. Cl. ..... 206/471; 206/231; 206/349; 248/489

(58) Field of Classification Search ..... 206/231, 206/349, 372, 461–471, 775–782, 806; 248/301, 248/217.1, 317, 475.1, 489, 497
See application file for complete search history.

(56) References Cited

U.S. PATENT DOCUMENTS 2,522,901 A 9/1950 Schrager et al.
2,876,899 A * 3/1959 Maynard, Jr. ..... 206/471
2,884,127 A * 4/1959 Neary ..... 206/462
3,178,019 A 4/1965 Fetzek
4,132,312 A 1/1979 Kamada
4,307,803 A 12/1981 Johnson
4,336,884 A 6/1982 Hart et al.
4,384,648 A 5/1983 Hart et al.
4,917,245 A 4/1990 Wu
5,064,056 A 11/1991 Gresh
5,176,258 A * 1/1993 Antal ..... 206/461
5,755,323 A * 5/1998 Zahn et al. ..... 206/470
6,131,737 A 10/2000 Marshall
6,695,276 B2 * 2/2004 Skorka ..... 248/497

* cited by examiner

*Primary Examiner*—Bryon P Gehman
(74) *Attorney, Agent, or Firm*—Lowe Hauptman Ham & Berner LLP

(57) ABSTRACT

A point-of-sale device carries an article having plural interfitting parts that must be fitted together by a human assembler after purchase, and includes a panel for enabling the device to be presented to a prospective purchaser at a retail shop. The panel includes a container in which the interfitting parts of the article in the assembled condition are located. The container has a transparent region through which the interfitting parts, in their assembled condition, can be seen by a prospective purchaser. The point-of-sale device is mounted on a horizontally extending, elongated element carried by a pegboard.

14 Claims, 5 Drawing Sheets

POINT-OF-SALE DEVICE FOR AN ARTICLE HAVING PLURAL INTERFITTING PARTS

FIELD OF INVENTION

The present invention relates in general to a point-of-sale device for an article having plural interfitting parts when assembled and, more particularly, to a point-of-sale device wherein the interfitting parts of the article are located behind a transparent region of the device in the assembled condition of the article such that the interfitting parts can be seen by a prospective purchaser.

BACKGROUND ART

Many articles that are offered for sale, particularly hardware articles, including some picture hangers, have plural interfitting parts when assembled. The interfitting parts are frequently presented to a prospective purchaser in a point-of-sale device on a backing and presented to a prospective purchaser through a transparent cover, such as a so-called "blister pack." The interfitting parts are in a disassembled condition. As a result, many persons find assembling the interfitting parts to be a daunting experience.

A commercially available picture hanger, illustrated in FIG. 1 in its point-of-sale configuration, is known as the NO-STUD. The NO-STUD picture hanger includes a plate 10 with a rectangular opening 12, as well as nail openings 14. Picture hanger structure 16 has a shoulder 18 that extends through opening 12 in plate 10 when the NO-STUD hanger is assembled. Hanger structure 16 includes leg 22 that (1) carries hook 24 and (2) downwardly depends from shoulder 18. Hanger structure 16 also includes arm 20 that upwardly extends from shoulder 18 when plate 10 is mounted on a wall. During a mounting operation, opening 12 in plate 10 is aligned with an opening in the wall and arm 20 engages the side of the wall opposite from the side of the wall against which plate 10 bears.

The picture hanger of FIG. 1 has been marketed by mounting plate 10, hanger structure 16, and nails 28 in transparent blister pack 26. Blister pack 26, plate 10, hanger structure 16, and nails 28 are carried by panel 30 that includes an illustration 32 of the assembled picture hanger. Panel 30 includes elongated, horizontally-extending opening 34, which is fitted onto an elongated element of a point-of-sale system, typically including a pegboard from which the elongated element extends.

Presentation of the product on the point-of-sale device of FIG. 1 is not particularly attractive. Further, many prospective purchasers have difficulty determining how to insert hanger structure 16 into opening 12 of plate 10 based on illustration 32 and written information on backing 30.

To assemble the picture hanger of FIG. 1, plate 10 is fastened to a wall by hammering nails 28 through openings 14 into a wall having a hole aligned with opening 12 in the plate. As illustrated in FIGS. 2A and 2B, hanger structure 16 is inserted through opening 12 in plate 10 and the hole in the wall so that shoulder 18 extends substantially at right angles to the faces of the wall, and leg 22 and arm 20 are respectively located in front and in back of the wall.

It is, therefore, an object of the present invention to provide a new and improved point-of-sale device having plural interfitting parts when assembled.

It is another object of the present invention to provide a new and improved point-of-sale device having plural interfitting parts, wherein the article is presented to a prospective purchaser in an aesthetically pleasing manner to enhance sales.

It is a further object of the present invention to provide a new and improved point-of-sale device wherein plural interfitting parts of an article are presented to a prospective purchaser in a manner that enables the prospective purchaser to easily determine how the interfitting parts are assembled and connected together in use.

Still another object of the present invention is to provide a new and improved point-of-sale device for a picture hanger including a plate with an opening and a hanger structure having a shoulder structure that extends through the opening in the plate when the picture hanger is mounted on a wall, wherein the hanger structure includes a leg downwardly depending from the shoulder.

SUMMARY OF THE INVENTION

In accordance with an aspect of the present invention, a point-of-sale device carries an article having plural interfitting parts, wherein the article is displayed to a prospective purchaser through a transparent region which the article is behind in its assembled condition. The article is such that the interfitting parts must be disassembled and then fitted together by a human assembler after purchase of the article.

The point of sale device preferably includes a panel carrying information about the article. The information includes illustrations and words about how to assemble the article. The information is accessible to the prospective purchaser even though the article remains behind the transparent region and the prospective purchaser does not have access to the article Preferably, a container for the article formed by the panel and the transparent region includes a segment in which a portion of the article fits snugly. The segment cooperates with the panel to form a pocket into which the article portion snugly fits. The pocket holds the article portion so that the interfitting parts are held in place in the assembled condition between the transparent region and the panel.

The point-of-sale device is preferably of the type that is mounted on a horizontally extending, elongated element of a vertically extending mounting structure, such as a pegboard. To this end, the panel includes an opening for enabling the device to be mounted on the horizontally extended elongated element.

In one particular embodiment, as described in connection with FIGS. 1 and 2, the article comprises a picture hanger including a plate with an opening and a hanger structure having a shoulder extending through the opening in the plate. The hanger structure includes a leg that downwardly depends from the shoulder and an arm that upwardly extends from the shoulder when the hanger structure is inserted through the opening in the plate and a hole in a wall on which the plate is mounted. The opening in the plate and the hole in the wall are aligned. The plate and hanger structure are located in the container so that the shoulder is located in the opening of the plate, and the leg extends below the opening of the plate. The plate, leg, and arm extend in planes parallel to a planar surface of the panel. The hanger structure extends substantially at a right angle to the planar surface of the panel. At least portions of the plate, shoulder, arm, and leg are visible to the prospective purchaser through the transparent region in the same manner that these parts are ultimately assembled. The presentation of such an article is particularly more informative and attractive than the presentation of the device illustrated in FIG. 1. The prospective purchaser can immediately determine how the various parts fit together with each other when the picture hanger is assembled. As a result, sales of the picture hanger are enhanced.

The above and still further objects, features and advantages of the present invention will become apparent upon consideration of the following detailed description of a specific embodiment thereof, especially when taken in conjunction with the accompanying drawings.

BRIEF DESCRIPTION OF THE DRAWINGS

As previously described.

DETAILED DESCRIPTION OF THE PREFERRED EMBODIMENT

Figure 3:
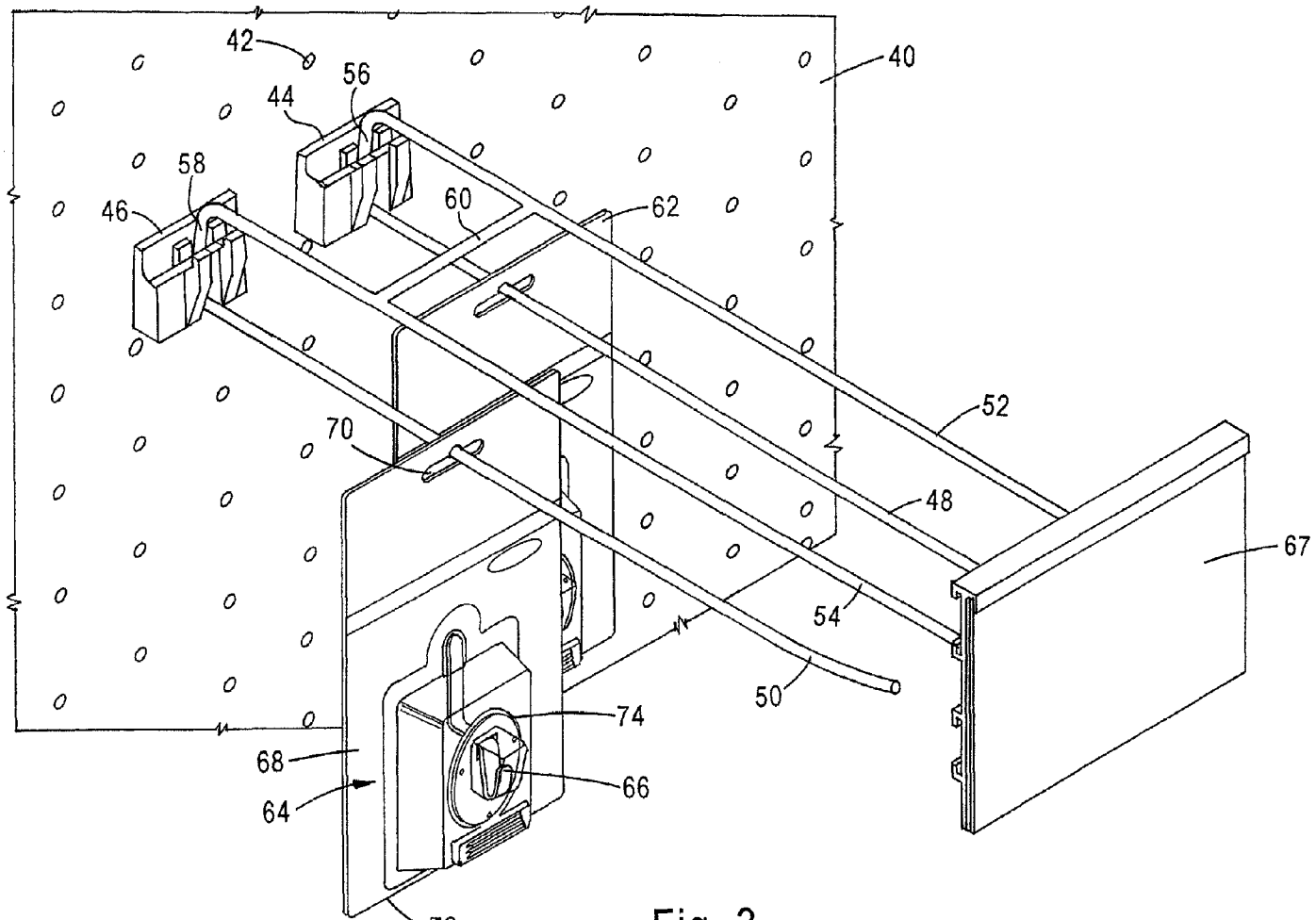
FIG. 3 is a perspective view of a point-of-sale system including a point-of-sale device in accordance with a preferred embodiment of the present invention.

The point-of-sale system of FIG. 3 includes vertically extending, wall-mounted pegboard 40 including circular holes 42. Pegboard 40 fixedly carries fixtures 44 and 46, on which are fixedly mounted horizontally extending elongated elements in the form of rods 48, 50, 52 and 54, pairs of which are connected together by vertically extending struts 56 and 58, as well as horizontally extending struts 60. Struts 56 and 58 respectively fit into openings of fixtures 44 and 46.

Figure 1:
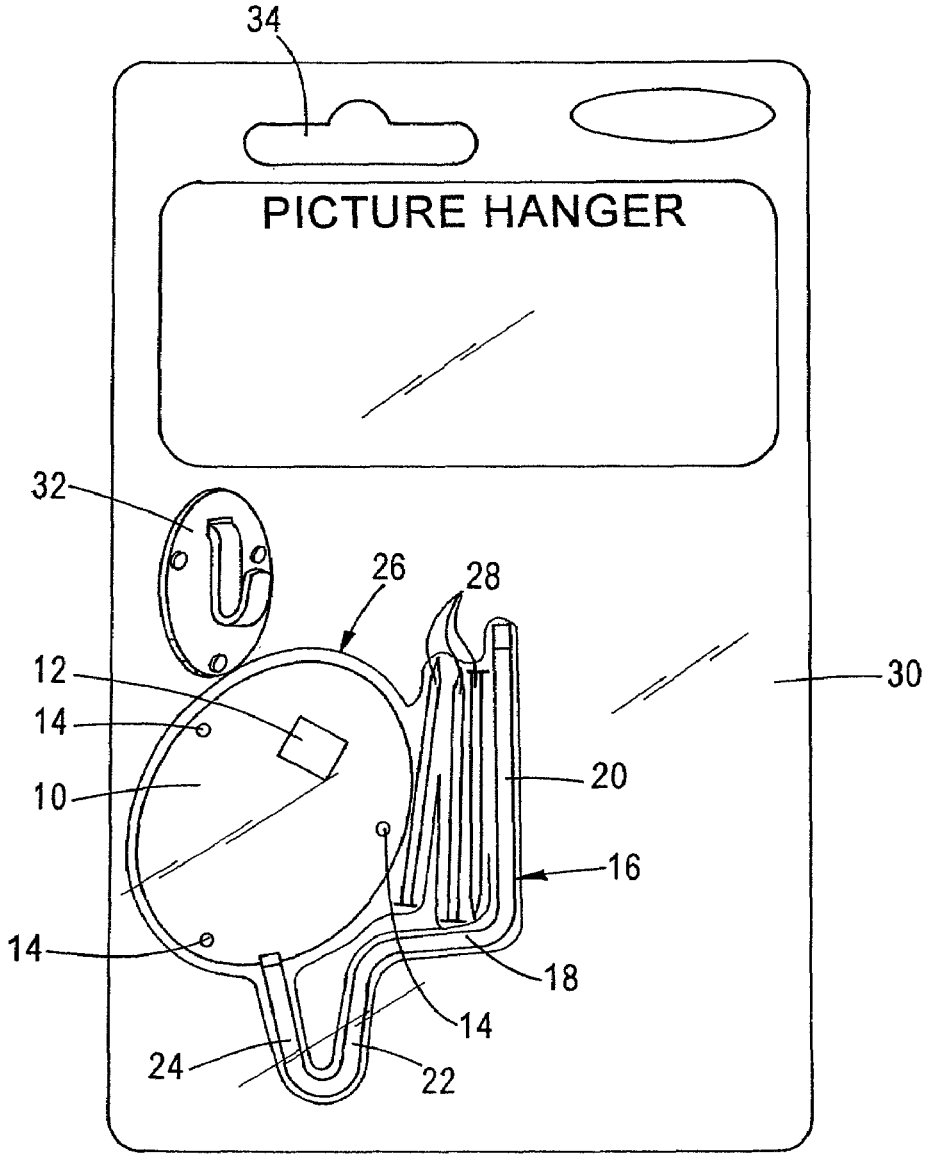
Fig. 1 (PRIOR ART)
FIG. 1 is a drawing of a prior art point-of-sale device for a picture hanger.
Figure 2A:
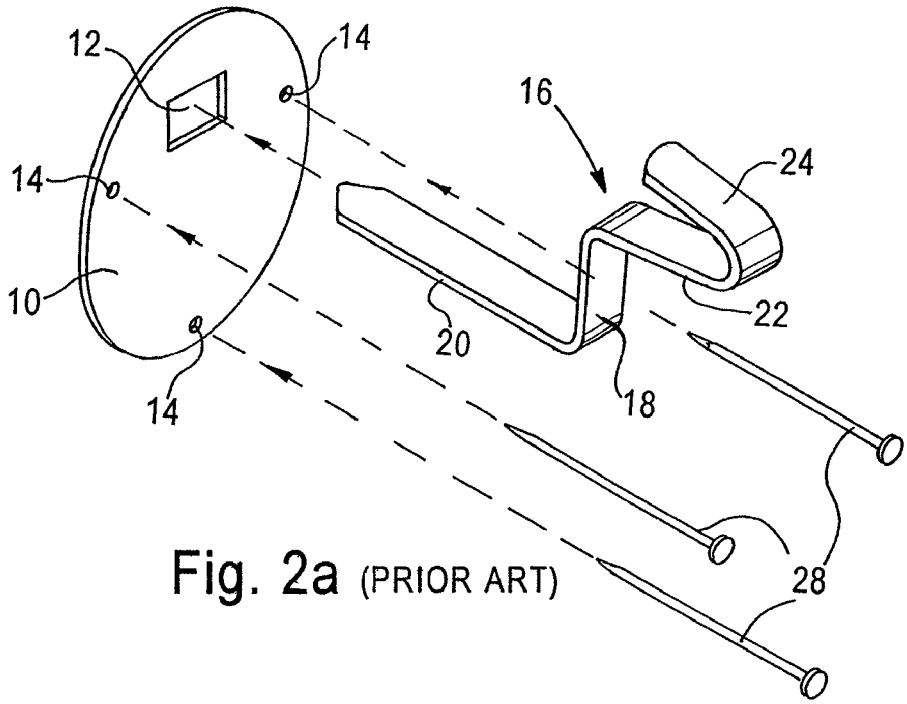
Fig. 2a (PRIOR ART)
FIGS. 2A and 2B are illustrations of how the parts of the picture hanger illustrated in FIG. 1 are assembled.

Point-of-sale devices 62 and 64 are respectively hung on rods 48 and 50 behind placard 67, which is mounted on rods 52 and 54 and includes information about article 66, carried by point-of-sale devices 62 and 64. Article 66 is a picture hanger including plate 10, nails 14, and hanger structure 16 (see FIGS. 1, 2*a*, and 2*b*) and is located, in assembled condition, on cardboard panel 68, including horizontally extending elongated opening 70, sized and oriented for enabling point-of-sale device 64 to be mounted on one of rods 48 or 50. Article 66, in assembled condition, is located in a chamber, i.e., container, between planar surface 72 of panel 68 and exterior surfaces of one piece, transparent plastic cover 74, which is fixedly mounted on the planar surface. Thus, article 66 can be considered to be behind cover 74 that forms a transparent region of point of sale device 64.

Container 74 includes walls 76, 78, 80, and 82, which extend approximately at right angles to planar surface 72 and to each other. At the bottom of walls 76, 78, 80, and 82 is flange 84, having a bottom surface abutting and fixedly connected by transparent glue to planar surface 72. At the top of walls 76, 78, 80, and 82 is ceiling 86 of cover 74. Ceiling 86 has a planar surface that extends parallel to planar surface 72. Ceiling 86 includes oval portion 88, the periphery of which is connected to planar portion 87 of ceiling 86 by wall 90, having a height slightly greater than the thickness of plate 10. Plate 10 fits into a cavity formed by oval portion 88 and wall 90 and is held in place by transparent adhesive tape 91, which forms the floor of the cavity. The unexposed, bottom face of plate 10 abuts tape 91.

Figure 5:
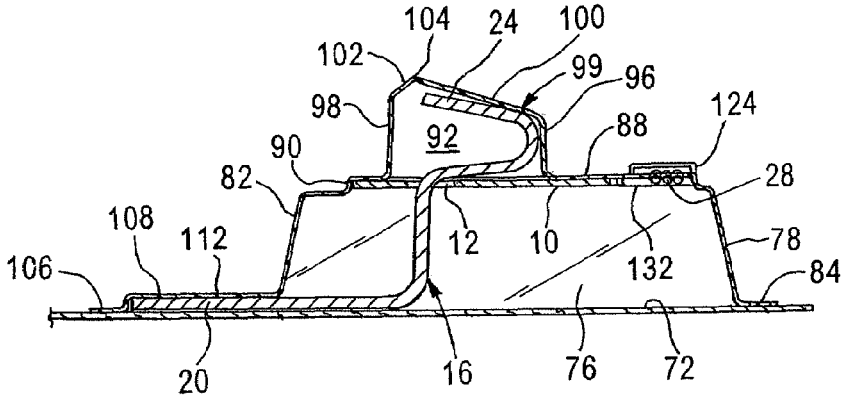
FIG. 5 is a side view, taken through the line 5-5 of FIG. 4.

Extending upwardly from ceiling portion 88 is bulbous portion 92 of cover 74. Bulbous portion 92 is shaped for (1) receiving leg 22 and hook 24 of hanger structure 16 and (2) in such a way as to facilitate insertion of the leg and hook portions of the hanger structure, as well as to hold the leg and hook portions in place. To this end, bulbous portion 92 includes (1) sidewalls 94 that taper toward each other and away from ceiling portion 88, (2) floor 96, and (3) ceiling 98; floor 96 and ceiling 98 extend away from ceiling portion 88. Bulbous portion 92 also includes a front wall including (1) segment 100 that extends upwardly at an oblique angle from floor 96 (FIG. 5) and (2) portion 102 that extends upwardly from ceiling 98. Wall portions 100 and 102 meet at apex 104 at a distance sufficiently far from roof portion 88 to accommodate leg 22 and hook 24, so a portion of hook 24 bears against a segment of wall portion 100 to assist in holding hanger structure 16 in place. The exposed face of plate 10 bears against wall portion 88, which has a shape and size substantially the same as, but slightly larger, than the oval shape of plate 10.

Figure 2B:
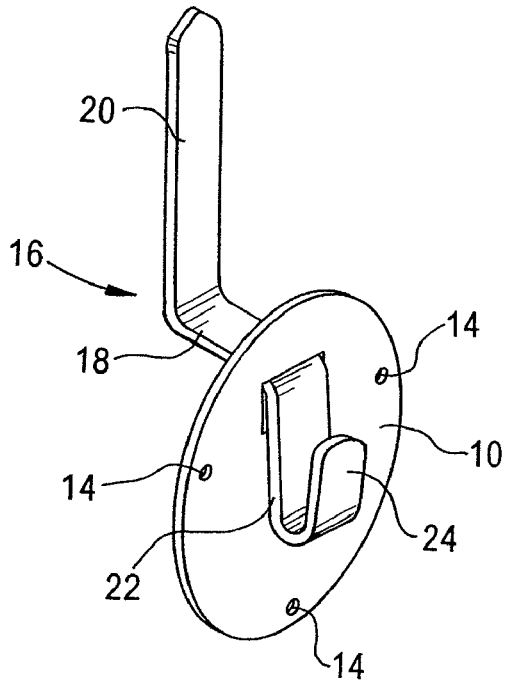
Fig. 2b (PRIOR ART)
Figure 6:
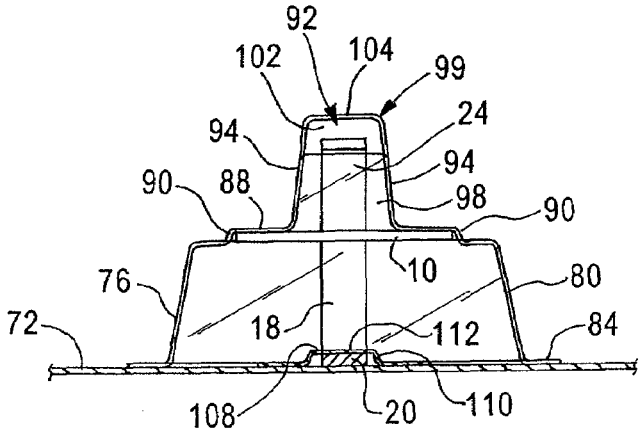
FIG. 6 is a side view taken through the line 6-6 of FIG. 4.

To assist in holding hanger structure 16 and plate 10 in place in the assembled condition, as illustrated in FIG. 2B, flange 84 includes tongue 106 (FIG. 5) that extends from the remainder of container 74 toward opening 70. Tongue 106 includes a central elongated opening 108, having length, width, and thickness dimensions to snugly receive arm 20 when plate 10 is located in the chamber formed by wall 90, oval ceiling portion 88 and tape 91. Wall 110 (FIG. 6), having a height slightly greater than the thickness of arm 20, extends from the edges of tongue 106, where opening 108 is formed. At the top of wall 110 is ceiling 112 that is connected to the portion of wall 82 from which tongue 106 extends and through which an opening 114 is thereby provided in a portion of wall 82 connected to tongue 106. Arm 20 is located in opening 114. Tongue 106, opening 108, wall 110, ceiling 112 and the portion of panel 68 that abuts opening 108 form a chamber (i.e., pocket) in which arm 20 snugly fits. The snug fit of arm 20 in the pocket, in combination with the snug fit of plate 10 against oval ceiling portion 88, as well as tape 91, and the snug fit of hook 24 against roof portion 100 of bulbous portion 92 of cover 74 hold plate 10 and hanger structure 16 firmly in place in the assembled condition. In the assembled condition, plate 10, arm 20, and leg 22 extend in planes substantially parallel to planar surface 72, and shoulder 18 extends substantially at a right angle to planar surface 72.

Figure 4:
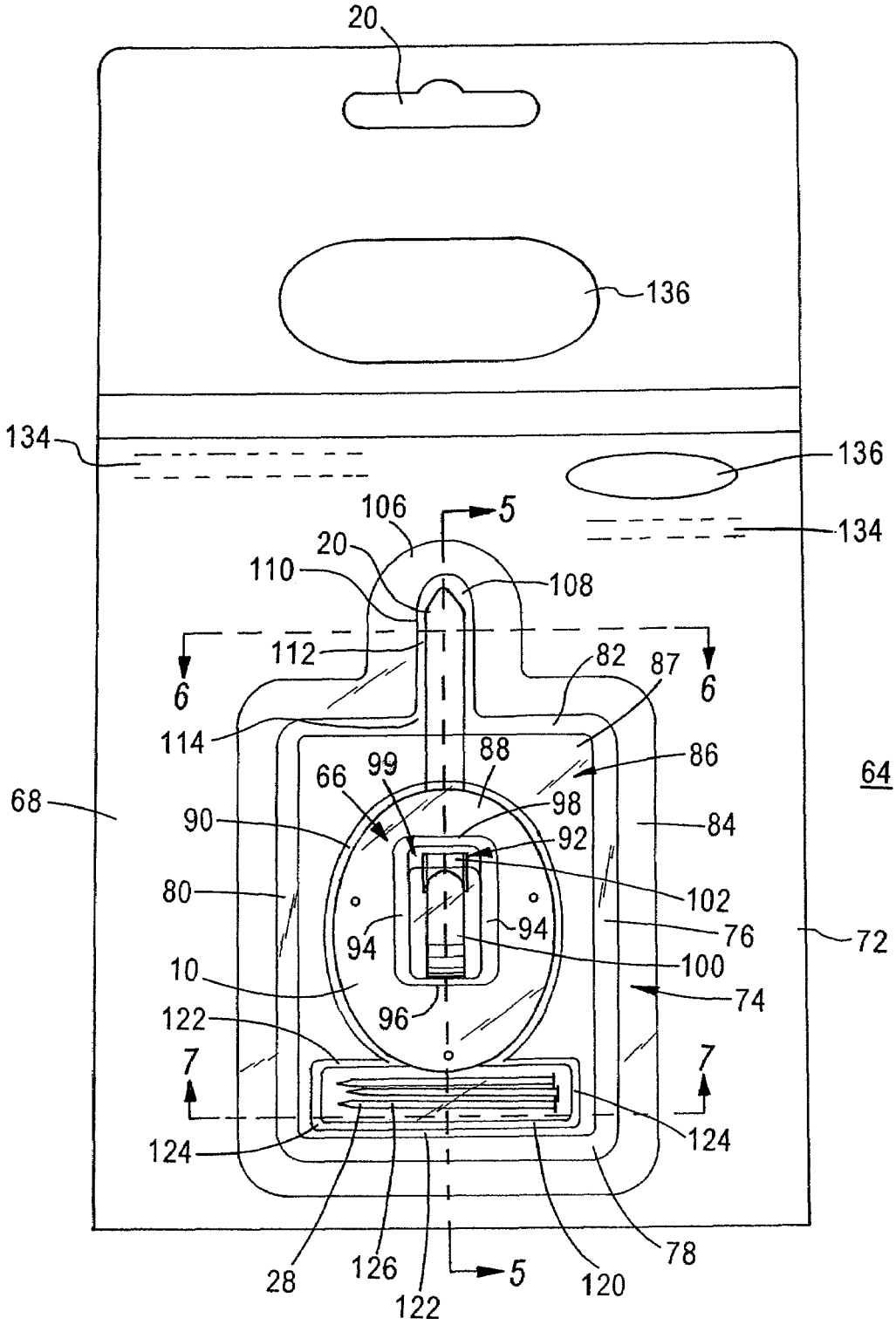
FIG. 4 is a front view of the point-of-sale device illustrated in FIG. 3.
Figure 7:
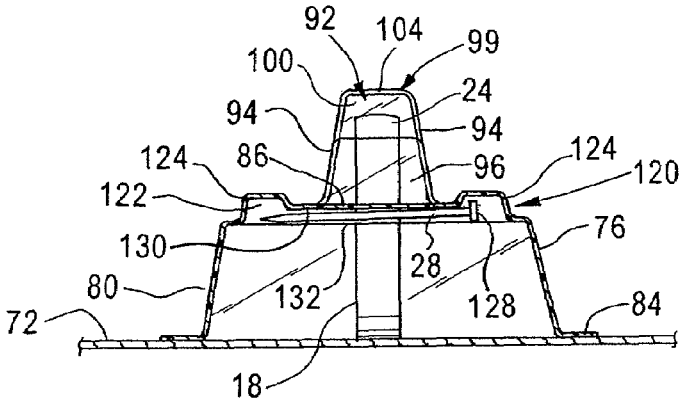
FIG. 7 is a side view taken through the line 7-7 of FIG. 4.

The presentation is enhanced by the prominent position of nails 28 in cover 74. Nails 28 are located immediately below the planar portion of transparent ceiling 86, where the nails can easily be seen by a prospective purchaser. Nails 28 are located in chamber 120 (FIGS. 4, 5, and 7), including elongated parallel walls 122 and sidewalls 124 that extend at right angles to walls 122. The central portions of elongated walls 122 have a height slightly greater than the diameters of the elongated portions 126 of nails 28, while walls 124 and the end portions of elongated walls 122 have a height slightly greater than the diameters of heads 128 of nails 28. Chamber 120 also includes roof 130 that is an integral part of cover 74, as are walls 122 and 124. Chamber 120 further includes floor 132, formed of transparent cellophane adhesive tape that is attached to the underside of the planar portion of ceiling 86 of cover 74, after nails 28 have been inserted into chamber 120 between walls 122 and 124, against ceiling 130 while cover 74 is in an inverted position, prior to plate 10 and hanger structure 16 being inserted into the chamber including cover 74.

The prominent location of nails 28 and the location of the nails in chamber 120 enable the prospective purchaser to realize easily what is involved in securing the picture hanger in place. In addition, the person assembling the picture hanger can leave the nails in place in chamber 120 after removing plate 10 and hanger structure 16 in the assembled condition from the pocket including cover 74 and backing 68 of point-of-sale device 64. Hence, the likelihood of nails 28 being misplaced or lost is considerably reduced.

Panel 68, in addition to carrying plate 10, hanger structure 16, nails 28, and container 74, includes a text message 134 containing information about the picture hanger, as well as illustrations 136, to assist the person assembling the picture hanger. Text message 134 and illustrations 136 are accessible to the prospective purchaser even though the picture hanger remains behind the transparent cover 74, and the prospective purchaser does not have access to the picture hanger.

While a specific embodiment of the invention has been described and illustrated, variations regarding details of the embodiment specifically illustrated and described may be made without departing from the true spirit and scope of the invention as defined in the appended claims.

What is claimed is:

1. A point-of-sale device carrying an assembled article having plural interfitting parts, the assembled article being such that the interfitting parts must be disassembled and then fitted together by a human assembler after purchase of the article, the device comprising:

a structure for enabling the device to be presented to a prospective purchaser at a retail shop, the structure including a transparent region, the interfitting parts of the article being located in the structure behind the transparent region, the interfitting parts in the structure being in the assembled condition thereof so that the interfitting parts, in the assembled condition thereof, can be seen by the prospective purchaser through the transparent region while the device is presented to the prospective purchaser at the shop, the article comprising a picture hanger including a plate with an opening and a hanger structure having a shoulder extending through the opening in the plate; the hanger structure including a leg downwardly depending from the shoulder and an arm upwardly extending from the shoulder; the plate and the hanger structure being located in the structure so that the shoulder is located in the opening of the plate; and the leg extends below the opening of the plate; the plate, leg, and arm extending in planes substantially parallel to a planar surface of the structure; the shoulder extending substantially at a right angle to the planar surface of the structure; at least portions of the plate, shoulder, arm, and leg being visible to the prospective purchaser through the transparent region.

2. The point-of-sale device of claim 1, wherein the structure includes a panel carrying indicia including information about the article to the prospective purchaser, the panel and the transparent region forming a container in which the article is located, the container including a segment in which a portion of the article fits snugly, the segment cooperating with the panel to form a pocket into which the portion snugly fits, the pocket holding the portion, the interfitting parts being held in place in the assembled condition between surfaces of the container and panel.

3. The point-of-sale device of claim 2, wherein the structure includes an opening for enabling the device to be mounted on a horizontally extending element of a vertically extending mounting structure.

4. The point-of-sale device of claim 3, wherein the container includes surfaces remote from the panel for confining movement of the plate while the plate is in the container.

5. The point-of-sale device of claim 4, in combination with a vertically extending mounting structure carrying a horizontally extending, elongated element, the structure including an opening, the elongated element extending through the opening.

6. The point-of-sale device of claim 2, wherein the container includes surfaces remote from the panel that confine movement of the hanger structure.

7. The point-of-sale device of claim 6, wherein the container includes surfaces remote from the panel that confine movement of the hanger structure.

8. A point-of-sale device carrying an assembled article having plural interfitting parts, the article being such that the interfitting parts must be disassembled and then fitted together by a human assembler after purchase of the article, the device comprising:

a structure for enabling the device to be presented to a prospective purchaser at a retail shop, the structure including a transparent region, the structure including a panel carrying indicia including information about the article to the prospective purchaser, the panel and the transparent region being included in a container in which the article is located, the container including a segment in which a portion of the article fits snugly, the article in the container comprising a picture hanger including a plate with an opening and a hanger structure having a shoulder extending through the opening in the plate; the hanger structure in the container including a leg downwardly depending from shoulder and an arm upwardly extending from the shoulder; the plate and the hanger structure being assembled in the container so that the shoulder is located in the opening of the plate and the leg extends below the opening of the plate; the plate, leg, and arm in the container extending in planes substantially parallel to a planar surface of the panel; the shoulder in the container extending substantially at a right angle to the planar surface of the panel; at least portions of the plate and leg in the container being visible to the prospective purchaser through the transparent region.

9. The point-of-sale device of claim 8, wherein the structure is arranged to enable the device to be mounted on a horizontally extending, elongated element of a vertically extending mounting structure.

10. The point-of-sale device of claim 8, in combination with a vertically extending mounting structure carrying a horizontally extending, elongated element, the structure of the device being arranged for enabling the device to be mounted on the elongated element.

11. The point-of-sale device of claim 8, in combination with a vertically extending mounting structure carrying a horizontally extending, elongated element, the structure of the device including an opening in a panel, the panel (a) carrying a container in which the article is located and including the transparent region, and (b) bearing information about the article, the elongated element extending through the opening.

12. The point-of-sale device of claim 8, wherein the structure includes a panel with information about how to assemble the article and connect the interfitting parts together, the information being accessible to the prospective purchaser even though the article remains behind the transparent region, and the prospective purchaser does not have access to the article.

13. The point-of-sale device of claim 8, wherein the structure includes an opening for enabling the device to be mounted on a horizontally extending element of a vertically extending mounting structure.

14. The point of sale device of claim 8 wherein the panel carries the transparent region.

* * * * *